US009311873B2

(12) United States Patent
He

(10) Patent No.: US 9,311,873 B2
(45) Date of Patent: Apr. 12, 2016

(54) POLARITY INVERSION DRIVING METHOD FOR LIQUID CRYSTAL DISPLAY PANEL, DRIVING APPARATUS AND DISPLAY DEVICE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventor: Jian He, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 48 days.

(21) Appl. No.: 14/369,494

(22) PCT Filed: Sep. 30, 2013

(86) PCT No.: PCT/CN2013/084658

§ 371 (c)(1),
(2) Date: Jun. 27, 2014

(87) PCT Pub. No.: WO2015/000234

PCT Pub. Date: Jan. 8, 2015

(65) Prior Publication Data

US 2015/0084941 A1 Mar. 26, 2015

(30) Foreign Application Priority Data

Jul. 5, 2013 (CN) ..... 2013 1 0282845

(51) Int. Cl.
*G06F 3/038* (2013.01)
*G09G 3/36* (2006.01)

(52) U.S. Cl.
CPC ..... *G09G 3/3614* (2013.01); *G09G 2310/06* (2013.01); *G09G 2320/0252* (2013.01); *G09G 2320/0257* (2013.01)

(58) Field of Classification Search
CPC ..... G09G 3/3614; G09G 2310/06; G09G 2320/0252; G09G 2320/0257
USPC ..... 345/690, 209, 214, 99, 96, 89, 32, 10
See application file for complete search history.

(56) References Cited

U.S. PATENT DOCUMENTS 8,605,022 B2 * 12/2013 Chen ..... G09G 3/3614 345/100
2004/0178981 A1 9/2004 Asada et al.
(Continued)

FOREIGN PATENT DOCUMENTS

CN 1530723 A 9/2004
CN 1705006 A 12/2005
(Continued)

OTHER PUBLICATIONS

International Search Report Appln. No. PCT/CN2013/084658; Dated Apr. 3, 2014.
(Continued)

*Primary Examiner* — Kent Chang
*Assistant Examiner* — Nelson Rosario
(74) *Attorney, Agent, or Firm* — Ladas & Parry LLP

(57) ABSTRACT

The present disclosure relates to a technical field of liquid crystal display, and particularly, to a polarity inversion driving method for a liquid crystal display panel, a driving apparatus and a display device. In the method, each of frames is divided into M polarity arrangement units in a same way, and every 2×M×N frames form one inversion driving period; in each of half inversion driving periods, there exists x, 0<x<=M×N, so that between the x-th frame and the (x+1)-th frame, except that polarities of first polarity arrangement units are same, polarities of all polarity arrangement units are opposite; for any m, 0<=m<M, between the (x+m×N)-th frame and the (x+m×N+1)-th frame, except that polarities of (m+1)-th polarity arrangement units are same, polarities of all polarity arrangement units are opposite; the polarity of each of the other frames is opposite to that of a frame adjacent thereto; in two of the half inversion driving periods adjacent to each other, the polarities of corresponding frames are opposite; in each of the polarity inversion driving periods, the overall polarity of each of the sub-pixels will not be deflected to a certain polarity, and a issue in which liquid crystal polarization or image sticking occurs in the liquid crystal at time of polarity inversion driving is avoided.

15 Claims, 7 Drawing Sheets

(56) References Cited

U.S. PATENT DOCUMENTS

| | | | |
|---|---|---|---|
| 2005/0264508 | A1 | 12/2005 | Nakamura et al. |
| 2008/0284706 | A1 | 11/2008 | Van Dalfsen et al. |
| 2008/0291189 | A1 | 11/2008 | Song et al. |
| 2012/0299884 | A1 | 11/2012 | Liu |

FOREIGN PATENT DOCUMENTS

| | | | |
|---|---|---|---|
| CN | 1973315 | A | 5/2007 |
| CN | 101226724 | A | 7/2008 |
| CN | 101312026 | A | 11/2008 |
| CN | 102629453 | A | 8/2012 |
| CN | 103310756 | A | 9/2013 |
| JP | 2002-149117 | A | 5/2002 |

OTHER PUBLICATIONS

First Chinese Office Action dated Dec. 1, 2014; Appln. No. 201310282845.X.

Second Chinese Office Action Appln. No. 201310282845.X; Dated Jul. 13, 2015.

International Preliminary Report on Patentability issued Jan. 5, 2016; PCT/CN2013/084658.

* cited by examiner

POLARITY INVERSION DRIVING METHOD FOR LIQUID CRYSTAL DISPLAY PANEL, DRIVING APPARATUS AND DISPLAY DEVICE

TECHNICAL FIELD

The present disclosure relates to a technical field of liquid crystal display, and particularly, to a polarity inversion driving method for a liquid crystal display panel, a driving apparatus and a display device.

BACKGROUND

Due to advantages of stable pictures, vivid images, eliminated radiation, economic space, economic power consumption and the like, Thin Film Transistor-Liquid Crystal Displays (TFT-LCDs) are widely applied to electronic products such as televisions, mobiles, displays and the like, and are dominant in the field of tablet display.

The liquid crystal display shown in FIG. 1 basically comprises a liquid crystal display panel (LCD panel) and a driving apparatus for the liquid crystal display panel, and the driving apparatus comprises components such as a source driver, a gate driver, a timing controller (T-con) and the like; signals transmitted to the liquid crystal display basically comprises image display signals R, G and B, enable signal DE, clock signal MCLK, and vertical synchronization signal Vsync and horizon synchronization signal Hsync. The timing controller transmits an image data signal (DATA), a row start signal (STH), a row latch signal (TP) and a polarity inversion signal (POL) to the source driver, and transmits a column start signal (STV), a column clock signal (CPV) and an output enable signal OE to the gate driver, so as to allow the liquid crystal display panel to display images.

An elementary image display unit of the liquid crystal display panel is a sub-pixel which takes on a capacitance effect in liquid crystal display panel structure, and an image will be displayed as long as a sufficient driving voltage is applied to two terminals thereof; and voltages applied to the two terminals of the capacitor are a common voltage and a data line voltage respectively. Therefore, if positive and negative polarity inversion is not performed on the voltage applied to the two terminals of the capacitor, the sub-pixels displaying the image will be charged for a long time with the same direct current voltage, and then a certain amount of charges will be deposited for a long time in a liquid crystal orientation layer and a liquid crystal layer between the common electrode and the pixel electrode, as shown in FIG. 2; this will cause the sub-pixels to be undesirably displayed, the liquid crystal polarization will be resulted therefrom to the worst extent so that the liquid crystal of the sub-pixels may fail, or image sticking will occur on the liquid crystal display panel even to a minor extent; that is, some background colors will be represented at time of display, and color contrast will be decreased too. Therefore, the signal voltages for driving the sub-pixels need the positive and negative polarity inversion at intervals, and an existing general approach is to alternatively perform polarity inversion between odd and even frames.

Even if the signal voltages with the positive and negative polarity are alternatively applied to the sub-pixels of the liquid crystal display panel, however, it is still possible that the signal voltages finally applied to the sub-pixels of the liquid crystal display panel are undesirable in terms of the positive and negative symmetry due to factors such as original positive and negative voltages provided by the driving circuit being undesirable in terms of symmetry, characteristics of the liquid crystal display panel itself being undesirable, an issue of image signal mode provided by a custom system, signal instability or the like; after the image is display for a long time, due to deflection to a certain polarity as a whole, the issues of the liquid crystal polarization or image sticking will occur generally.

SUMMARY

The present disclosure provides a polarity inversion driving method for a liquid crystal display panel to avoid such a issue that liquid crystal polarization or image sticking occurs in the liquid crystal at time of polarity inversion driving; further, embodiments of the present disclosure also provide a polarity inversion driving apparatus for the liquid crystal display panel for implementing the driving method, and a display device comprising the polarity inversion driving apparatus for the liquid crystal display panel.

Technical solutions according to embodiments of the present disclosure are as follows.

A polarity inversion driving method for a liquid crystal display panel comprises: each of frames being divided into M polarity arrangement units in a same way, every $2\times M\times N$ frames being one inversion driving period, in each of half inversion driving periods, $\exists! x\in(0, M\times N]$, between the x-th frame and the (x+1)-th frame, except that polarities of first polarity arrangement units are same, polarities of all polarity arrangement units are opposite; $\forall m\in[0, M)$, between in the $(x+m\times N)$-th frame and the $(x+m\times N+1)$-th frame, except that polarities of (m+1)-th polarity arrangement units are same, polarities of all polarity arrangement units are opposite; the polarity of each of the other frames is opposite to that of a frame adjacent thereto; wherein, each of M, N, x and m is an integer number, and value of $M\times N$ is an even number; when one of expressions of $(x+1)>M\times N$, $(x+m\times N)>M\times N$ or $(x+m\times N+1)>M\times N$ is satisfied, (x+1) represents the first frame in the half inversion driving period, $(x+m\times N)$ represents the $(x+m\times N-M\times N)$-th frame in the half inversion driving period, and $(x+m\times N+1)$ represents the $(x+m\times N-M\times N+1)$-th frame in the half inversion driving period, wherein in two of the half inversion driving periods adjacent to each other, the polarities of corresponding frames are opposite.

Optionally, in the x-th frame of each of the half inversion driving period, polarities of any two adjacent polarity arrangement units are opposite.

Optionally, each of the frames represents a polarity arrangement unit, N being an even number, polarity inversion driving period is a frame of 2N, and in each of the half inversion driving periods, only one set of two frames adjacent to each other are same in terms of polarity, and the other sets of two frames adjacent to each other are opposite in terms of polarity.

Optionally, in each of the frames, P rows are configured as a polarity arrangement unit.

Optionally, in each of the frames, each of the rows is a polarity arrangement unit; the first polarity arrangement unit is the first row, and the (m+1)-th polarity arrangement unit is the (m+1)-th row.

Optionally, M is an even number and N is equal to 1.

Optionally, in each of the polarity arrangement units, polarities of any two adjacent sub-pixels are opposite.

Optionally, the polarity is a polarity with respect to a common electrode voltage.

An embodiment of the present disclosure also provides an apparatus for implementing any one of the above polarity inversion driving method for the liquid crystal display panel.

The apparatus for the polarity inversion driving method for the liquid crystal display panel, comprises a timing controller, a source driver and an calculator, wherein the timing controller outputs M polarity inversion signals corresponding to each of the polarity arrangement units respectively to the calculator, and the polarity inversion signals and the control signal are subjected to logic operation in the calculator to be inputted to the source driver;

in each of half inversion driving periods, the polarity inversion signal in the (x+m×N+1)-th frame corresponding to the (m+1)-th polarity arrangement unit is an in-phase signal of a corresponding polarity inversion signal in the (x+m×N)-th frame, and the polarity inversion signal in the other frames corresponding to the (m+1)-th polarity arrangement unit is an out-phase signal of a corresponding polarity inversion signal in a previous frame.

Optionally, the second polarity inversion signal corresponding to the (m+1)-th polarity arrangement unit is $POL_{m+1}$, the control signal $Cs_{m+1}$ corresponding to the second polarity inversion signal is a high level in the (x+m×N)-th frame, and is at a low level in other frames; the second polarity inversion signal in each of the frames corresponding to the (m+1)-th polarity arrangement unit and the control signal are subjected to a logic operation of $\overline{POL_m}\times\overline{Cs_m}+POL_m\times Cs_m$ in the calculator to generate a corresponding second polarity inversion in a next frame.

Optionally, the second polarity inversion signal corresponding to the (m+1)-th polarity arrangement unit is $POL_{m+1}$, the control signal $Cs_{m+1}$ corresponding to the second polarity inversion signal is a low level in the (x+m×N)-th frame, and is at a high level in other frames; the second polarity inversion signal in each of the frames corresponding to the (m+1)-th polarity arrangement unit and the control signal are subjected to a logic operation of $\overline{POL_m}\times Cs_m+POL_m\times\overline{Cs_m}$ in the calculator to generate a corresponding second polarity inversion signal in a next frame.

An embodiment of the present disclosure also provides a display device comprising the above polarity inversion driving apparatus for the liquid crystal display panel.

With polarity inversion driving method for a liquid crystal display panel according to the embodiments of the present disclosure, in each of the polarity inversion driving periods, the overall polarities of the sub-pixels will not be deflected to a certain polarity, the charges are prevented from being accumulated, and such a issue that liquid crystal polarization or image sticking occurs in the liquid crystal at time of polarity inversion driving is avoided.

DETAILED DESCRIPTION

Figure 1:
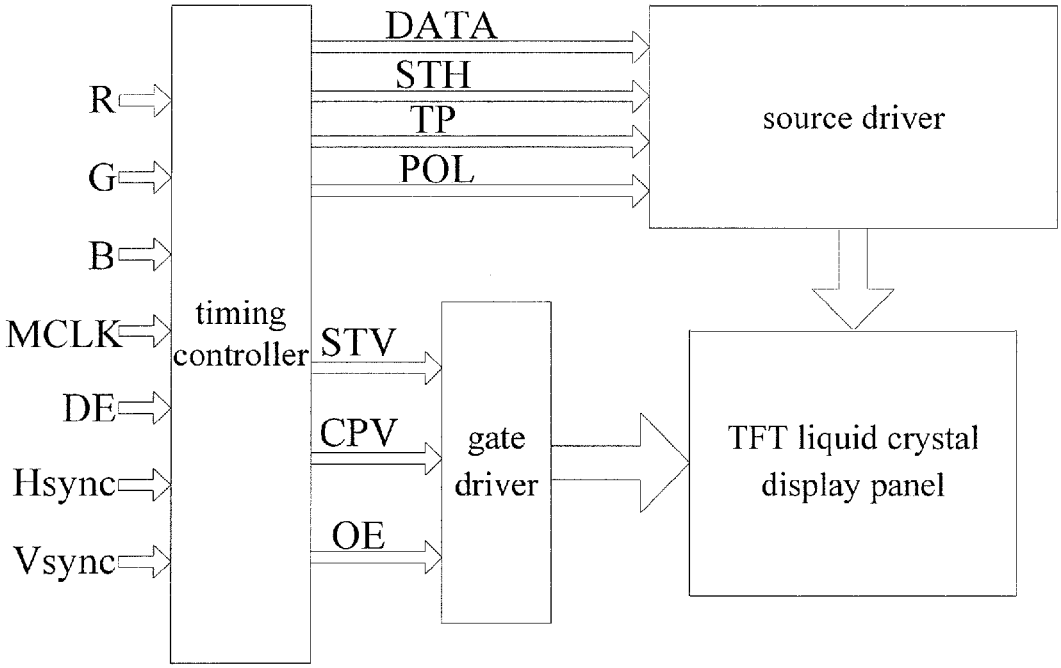
FIG. 1 is a schematic diagram of a structure of a polarity inversion driving apparatus for a known liquid crystal display panel.
Figure 2:
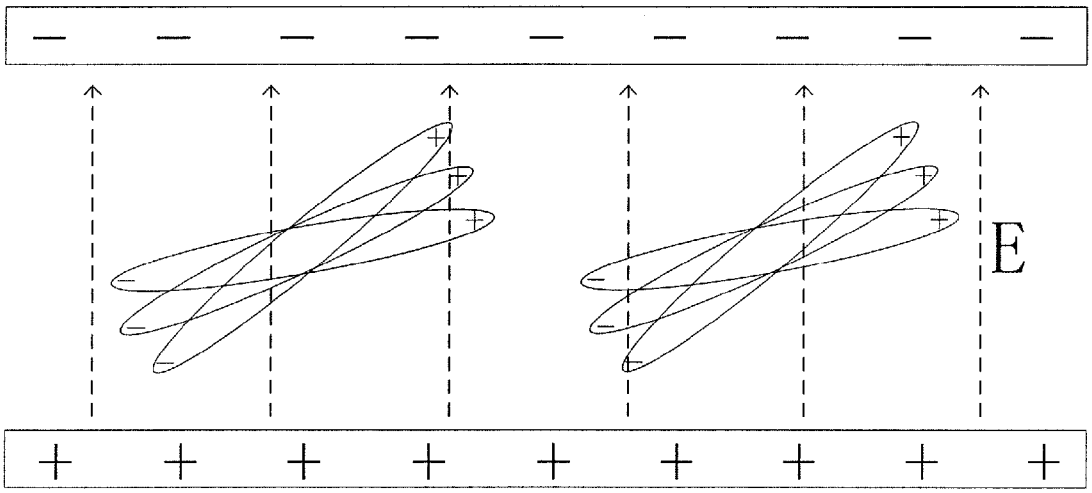
FIG. 2 is a schematic diagram showing influence of charges accumulated in the existing polarity inversion driving method for the liquid crystal display panel on the liquid crystal.

Hereinafter, specific implementations of the present disclosure will be further described with reference to the appended drawings and embodiments. The following embodiments are only intended to illustrate the present disclosure, and are not to limit the scope of the present invention.

In a polarity inversion driving method for a liquid crystal display panel according to an embodiment of the present disclosure, each of frames is divided into a number of M of polarity arrangement units in a same way; it is possible that every P rows form a polarity arrangement unit, the example of which is that every row forms a polarity arrangement unit or every two rows form a polarity arrangement unit or the like, and it is also possible that a frame forms a polarity arrangement unit; every 2×M×N frames indicate an inversion driving period, in each of half inversion driving periods M×N: $\exists!x\in(0, M\times N]$, between the x-th frame and the (x+1)-th frame, except for the polarity of the first polarity arrangement unit, polarities of all the polarity arrangement units are opposite; that is, between the x-th frame and the (x+1)-th frame, only the polarities of the first arrangement units are the same, and the polarities of the second to the M-th polarity arrangement units are opposite; between any other two adjacent frames during the half inversion driving period, the polarities of the first polarity arrangement units are opposite, where ∃! represents any number in a range;

$\forall m\in[0, M)$, between the (x+m×N)-th frame and the (x+m×N+1)-th frame, except for the polarity of the (m+1)-th polarity arrangement unit, polarities of all the polarity arrangement units are opposite; that is, whatever the value of m is, between the (x+m×N)-th frame and the (x+m×N+1)-th frame, the polarities of the (m+1)-th polarity arrangement units are the same, and the polarities of the first to the m-th and the (m+2)-th to the M-th polarity arrangement units are opposite; in any other two adjacent frames during the half inversion driving period, the polarities of the (m+1)-th polarity arrangement units are opposite, where V represents that the numeral in the range can be applicable in sequence;

during the half inversion driving period, the polarity of each of the other frames is opposite to that of a frame adjacent thereto are opposite; wherein, each of M and N is an integer number, value of M×N is an even number, and N represents that the inversion driving of positive and negative polarity alternation in every two frames is performed once every N frames; each of x and m is an integer number; when (x+1) >M×N, (x+1) represents the first frame in the half inversion driving period; when (x+m×N)>M×N, (x+m×N) represents the (x+m×N−M×N)-th frame in the half inversion driving period; when (x+m×N+1)>M×N, (x+m×N+1) represents the (x+m×N−M×N+1)-th frame in the half inversion driving period;

in any two of the half inversion driving periods adjacent to each other, the polarities of corresponding frames are opposite.

In one of the inversion driving periods, the overall polarity of each of the polarity arrangement units will not be deflected to a certain polarity, and thus it is avoided that the liquid crystal polarization or image sticking occurs in the liquid crystal at time of polarity inversion driving.

Hereinafter, specific implementations of the embodiments of the present disclosure will be explained in conjunction with examples.

First Embodiment

In this embodiment, a case where each of the frames is a polarity arrangement unit and N is an even number will be illustrated.

Figure 3:
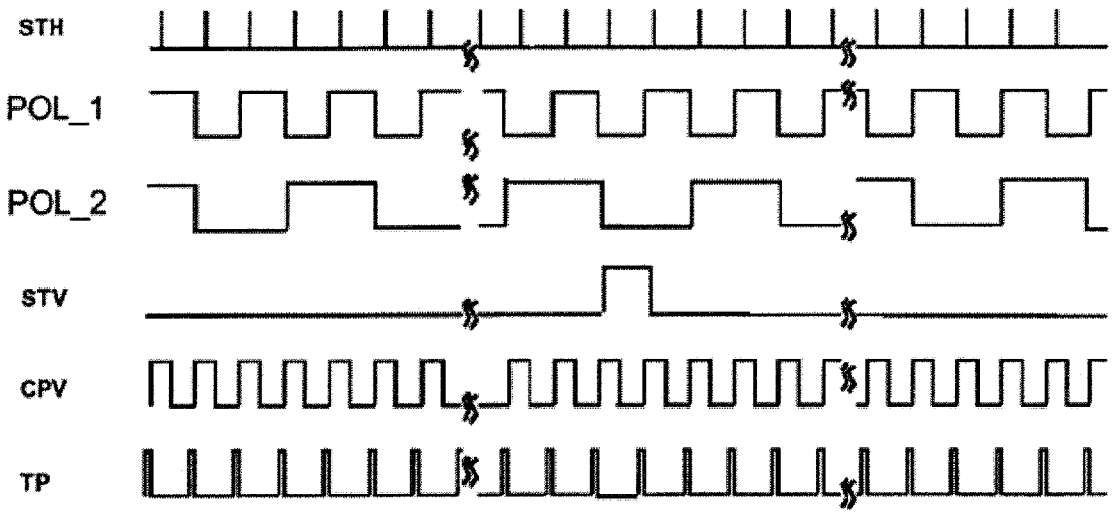
FIG. 3 is a schematic diagram showing a driving timing of the polarity inversion driving apparatus for the liquid crystal display panel of FIG. 1.

In the existing polarity inversion driving for the liquid crystal display panel, polarity inversion of a pixel voltage signal is performed once every frame; the known polarity inversion driving apparatus for the liquid crystal display panel is as shown in FIG. 1, for the polarity inversion signal POL outputted from the timing controller, the polarity inversion signal POL_1 and polarity inversion signal_2 will be illustrated; as shown in FIG. 3, the polarity inversion signal POL_1 is a periodic signal and takes a row start signal STH as a time reference; at a timing, the polarity inversion signal POL_1 is inverted once in corresponding to each of periods the row start signal STH; the polarity inversion signal POL_2 is a periodic signal and takes the row start signal STH as a time reference; at a timing, the second polarity inversion signal POL_2 is inverted once corresponding to each two of periods of the row start signal STH; in addition, according to specification of the control signals inputted to the liquid crystal display panel, the high and low potential inversion of the polarity inversion signal should be valid only in a certain time range starting from the row start signal STH.

As shown in tables 1 and 2, under control of the polarity inversion signal POL_1, polarities of any adjacent sub-pixels are opposite to each other and the polarities of any two frames adjacent to each other are opposite to each other; in this embodiment, the polarity is a polarity with respect to the voltage of a common electrode; in the tables 1 and 2, a symbol of "+" indicates a positive voltage with respect to the voltage of the common electrode, and the symbol of "−" indicates a negative voltage with respect to the voltage of the common electrode.

TABLE 1 polarity arrangement of odd frames in existing polarity inversion driving method

| | first column | second column | third column | fourth column | fifth column | . . . | n-th column |
|---|---|---|---|---|---|---|---|
| first row | + | − | + | − | + | . . . | − |
| second row | − | + | − | + | − | . . . | + |

TABLE 1-continued polarity arrangement of odd frames in existing polarity inversion driving method

| | first column | second column | third column | fourth column | fifth column | . . . | n-th column |
|---|---|---|---|---|---|---|---|
| third row | + | − | + | − | + | . . . | − |
| fourth row | − | + | − | + | − | . . . | + |
| fifth row | + | − | + | − | + | . . . | − |
| sixth row | − | + | − | + | − | . . . | + |
| seventh row | + | − | + | − | + | . . . | − |
| . . . | . . . | . . . | . . . | . . . | . . . | . . . | . . . |
| eighth row | − | + | − | + | − | . . . | + |

TABLE 2 polarity arrangement of even frames in existing polarity inversion driving method

| | first column | second column | third column | fourth column | fifth column | . . . | n-th column |
|---|---|---|---|---|---|---|---|
| first row | − | + | − | + | − | . . . | + |
| second row | + | − | + | − | + | . . . | − |
| third row | − | + | − | + | − | . . . | + |
| fourth row | + | − | + | − | + | . . . | − |
| fifth row | − | + | − | + | − | . . . | + |
| sixth row | + | − | + | − | + | . . . | − |
| seventh row | − | + | − | + | − | . . . | + |
| . . . | . . . | . . . | . . . | . . . | . . . | . . . | . . . |
| eighth row | + | − | + | − | + | . . . | − |

Due to factors such as original positive and negative voltages provided by the driving circuit being undesirable in terms of symmetry, characteristics of the liquid crystal display panel itself being undesirable, a issue of image signal mode provided by a custom system, signal instability or the like, it is possible that the signal voltages finally applied to the sub-pixels of the liquid crystal display panel are undesirable in terms of the positive and negative symmetry; for example, as shown in table 3, the overall polarity thereof is negative. In this way, after an image is displayed for a long time, the pixel voltage signal of each of sub-pixels is deflected to a certain polarity as a whole. For a single sub-pixel shown in FIG. 4 (sub-pixel shown in the drawing with background filled is exemplified), the overall voltage change in the single sub-pixel is shown in table 4; it can be seen that, the overall polarity of the single sub-pixel is negative, and thus, the issues of liquid crystal polarization or image sticking will occur.

TABLE 3 table of polarities of frames in the existing polarity inversion driving method

| | frame sequence number | | | | | | | | | | | | | | |
|---|---|---|---|---|---|---|---|---|---|---|---|---|---|---|---|
| row | 1 | 2 | . . . | N − 1 | N | N + 1 | N + 2 | . . . | 2N − 1 | 2N | 2N + 1 | 2N + 2 | . . . | 3N − 1 | 3N |
| 1 | L | H | . . . | L | H | L | H | . . . | L | H | L | H | . . . | L | H |
| 2 | H | L | . . . | H | L | H | L | . . . | H | L | H | L | . . . | H | L |
| 3 | L | H | . . . | L | H | L | H | . . . | L | H | L | H | . . . | L | H |
| 4 | H | L | . . . | H | L | H | L | . . . | H | L | H | L | . . . | H | L |
| 5 | L | H | . . . | L | H | L | H | . . . | L | H | L | H | . . . | L | H |
| 6 | H | L | . . . | H | L | H | L | . . . | H | L | H | L | . . . | H | L |
| 7 | L | H | . . . | L | H | L | H | . . . | L | H | L | H | . . . | L | H |
| 8 | H | L | . . . | H | L | H | L | . . . | H | L | H | L | . . . | H | L |
| Total | overall polarity is negative | | | | | overall polarity is negative | | | | | overall polarity is negative | | | | |

TABLE 4

Figure 4:
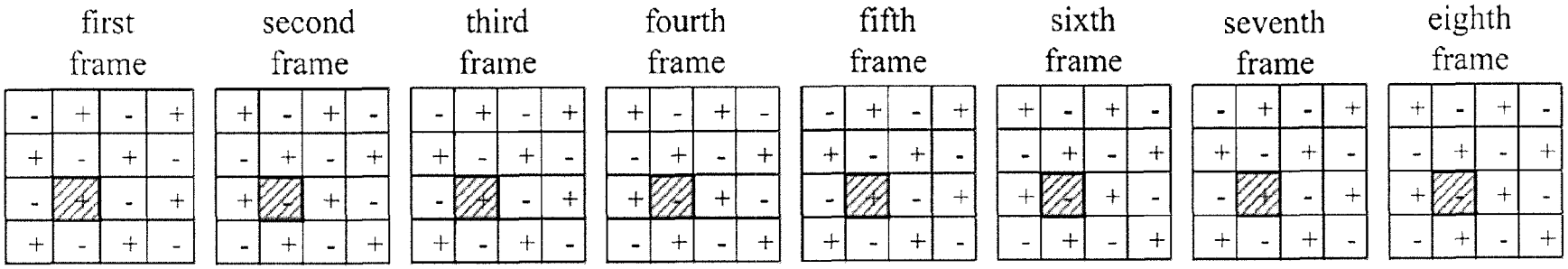
FIG. 4 is a schematic diagram showing polarity arrangement of frames in the existing polarity inversion driving method for the liquid crystal display panel.

| voltage changes in a single sub-pixel shown in FIG. 4 | | | | | | | | |
|---|---|---|---|---|---|---|---|---|
| | first frame | second frame | third frame | fourth frame | fifth frame | sixth frame | seventh frame | eighth frame |
| grey level | 0 | 128 | 0 | 128 | 0 | 128 | 0 | 128 |
| voltage | +0 V | −4 V | +0 V | −4 V | +0 V | −4 V | +0 V | −4 V |
| average voltage | −2 V | | −2 V | | −2 V | | −2 V | |
| defect | a voltage of −2 VDC is applied for a long time, and liquid crystal polarization or image sticking occurs. | | | | | | | |

Figure 5:
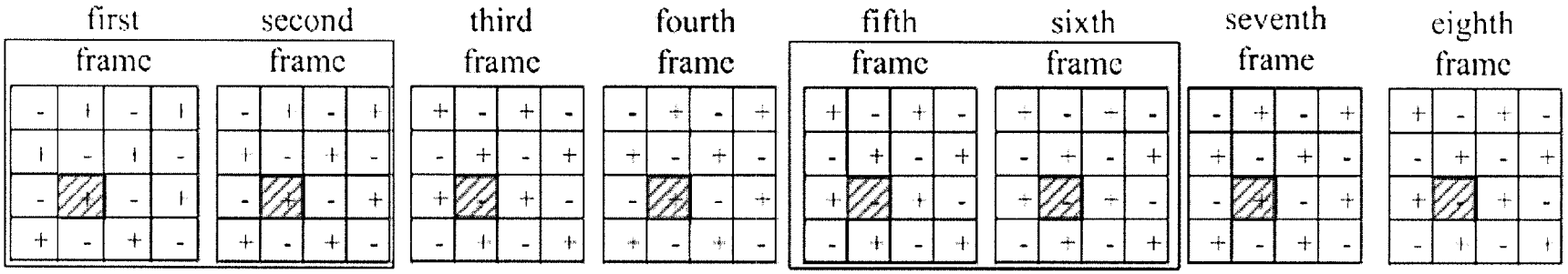
FIG. 5 is a schematic diagram showing polarity arrangement of frames in a polarity inversion driving method for a liquid crystal display panel of a first embodiment of the present disclosure.

On the basis of the driving method in which the positive and negative polarities are alternatively inverted per frame as described above, in the polarity inversion driving method for the liquid crystal display panel according to the embodiments of the present disclosure, every N frames, the inversion driving of positive and negative polarities alternation in two frames is performed once (referred to as two-frame inversion hereinafter), as shown in FIG. 5; in this way, polarity inversion driving period is 2N frame; in each of half inversion driving periods, only one set of two frames adjacent to each other are the same in terms of polarity, and in the half inversion driving period, the other sets of two frames adjacent to each other are opposite in terms of polarity; in any two of the half inversion driving periods adjacent to each other, the corresponding frames are opposite in terms of polarity.

TABLE 5

| Polarity table of the frames in the polarity inversion driving method of the present embodiment | | | | | | | | | | | | | | | |
|---|---|---|---|---|---|---|---|---|---|---|---|---|---|---|---|
| | frame sequence number | | | | | | | | | | | | | | |
| row | 1 | 2 | ... | N − 1 | N | N + 1 | N + 2 | ... | 2N − 1 | 2N | 2N + 1 | 2N + 2 | ... | 3N − 1 | 3N |
| 1 | L | H | ... | L | H | H | L | ... | H | L | L | H | ... | L | H |
| 2 | H | L | ... | H | L | L | H | ... | L | H | H | L | ... | H | L |
| 3 | L | H | ... | L | H | H | L | ... | H | L | L | H | ... | L | H |
| 4 | H | L | ... | H | L | L | H | ... | L | H | H | L | ... | H | L |
| 5 | L | H | ... | L | H | H | L | ... | H | L | L | H | ... | L | H |
| 6 | H | L | ... | H | L | L | H | ... | L | H | H | L | ... | H | L |
| 7 | L | H | ... | L | H | H | L | ... | H | L | L | H | ... | L | H |
| 8 | H | L | ... | H | L | L | H | ... | L | H | H | L | ... | H | L |
| Total | overall polarity is negative | | | | | overall polarity is positive | | | | | overall polarity is negative | | | | |

As can be apparently seen from FIG. 5, the overall polarity of each of the frames is alternated in the positive and negative. In this way, in displaying an image for long time, since the overall polarity of the pixel voltage signal of each of the sub-pixels is alternated in the positive and negative, the average voltage is equal to zero, and will not deflected to a certain polarity.

As shown in FIG. 5, when N=4, the two-frame inversion is performed once every four frames; for the single sub-pixel shown in FIG. 5 (sub-pixel shown in the drawing with background filled is exemplified), the overall voltage changes in the single sub-pixel is shown in table 6; it can be seen that, the overall average voltage of the single sub-pixel is equal to zero, and the polarity will not be deflected to a certain polarity, which prevents the charges from accumulating, and thus it is avoid that liquid crystal polarization or image sticking occurs in the liquid crystal at time of polarity inversion driving.

TABLE 6

| voltage changes in the single sub-pixel shown in FIG. 5 | | | | | | | | |
|---|---|---|---|---|---|---|---|---|
| | first frame | second frame | third frame | fourth frame | fifth frame | sixth frame | seventh frame | eighth frame |
| grey level | 128 | 0 | 128 | 0 | 128 | 0 | 128 | 0 |
| voltage | −4 V | −0 V | +4 V | −0 V | +4 V | +0 V | −4 V | +0 V |
| average voltage | −2 V | | +2 V | | +2 V | | −2 V | |
| defect | voltages of −2 V and +2 VDC are alternatively applied, the overall average voltage is equal to zero, and liquid crystal polarization or image sticking will not occur | | | | | | | |

In order to reduce impact of interference phenomenon of chroma and brightness in a frame, in the present embodiment, polarities of any two adjacent sub-pixels in each of the frames are opposite. Of course, other implementations are also possible; for example, three sub-pixels of RGB serve as a pixel unit, and polarities of any two adjacent pixel units in each of the frames are opposite, and the like.

Second Embodiment

Figure 6:
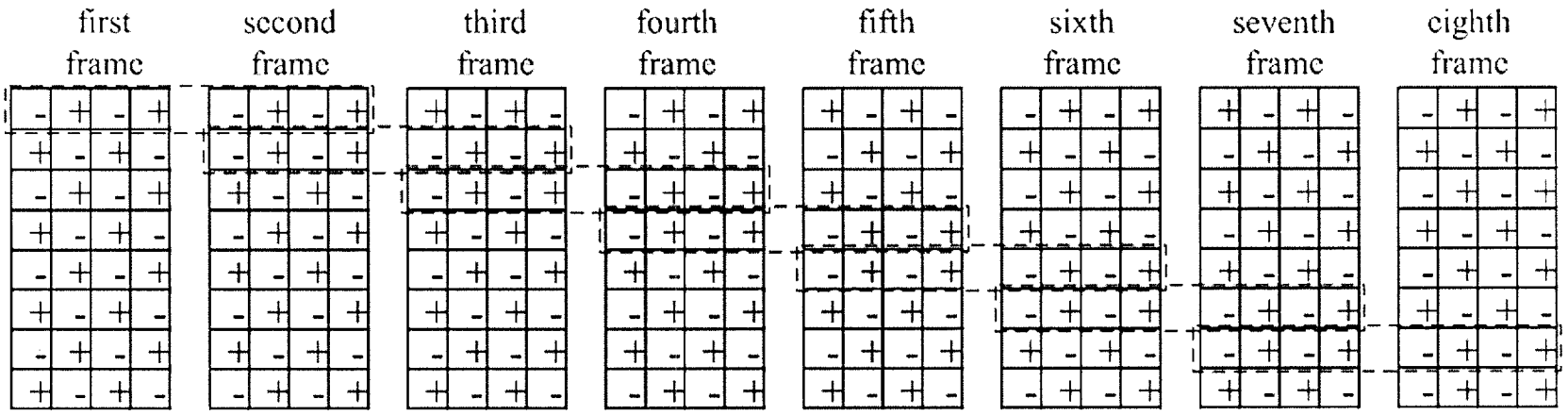
FIG. 6 is a schematic diagram showing, at time of N=1, polarity arrangement of frames in a polarity inversion driving method for a liquid crystal display panel of a second embodiment of the present disclosure.
Figure 7:
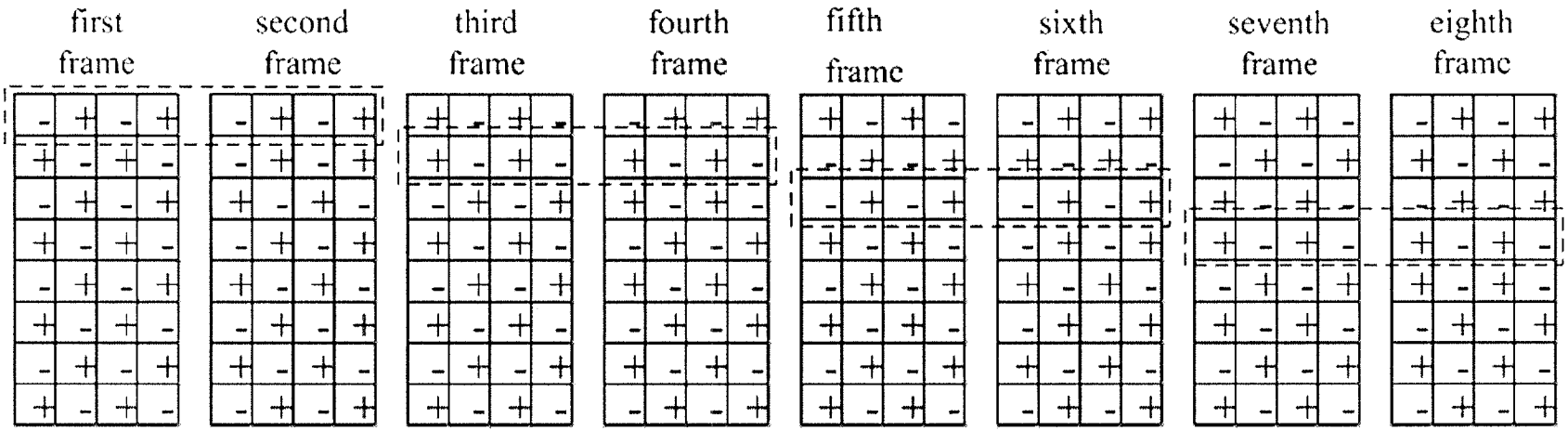
FIG. 7 is a schematic diagram showing, at time of N=2, polarity arrangement of frames in a polarity inversion driving method for a liquid crystal display panel of a second embodiment of the present disclosure.
Figure 8:
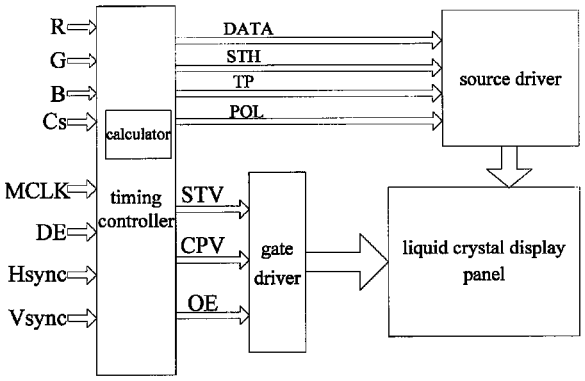
FIG. 8 is a schematic diagram showing a structure of a polarity inversion driving apparatus for a liquid crystal display panel of a third embodiment of the present disclosure.

The polarity inversion driving method for the liquid crystal display panel of the first embodiment is easy to be implemented and operated, however, since when the two-frame inversion is performed every N frames, the change in polarity of the full picture is not consistent with that of the other frames, and thus light and dark changes are generated, which is visually presented as a flicker phenomenon. In order to solve this issue, in this embodiment, each of the rows is a polarity arrangement unit; every N frames, the two-frame inversion is performed once on this row, and the two-frame inversion is performed alternatively on the respective rows, so that it is avoided that the full picture is changed simultaneously. For example, FIG. 7 shows polarity changes in respective rows in each of the frames with N=1. Polarity arrangement of the frames is as shown in FIG. 6; as can be seen from table 7 and FIG. 6 that, with respect to the first row, the two-frame inversion is performed at the second frame; with respect to the second row, the two-frame inversion is performed at the third frame; with respect to the third row, the two-frame inversion is performed at the fourth frame; with respect to the fourth row, the two-frame inversion is performed at the fifth frame, and the like. For another example, when N is equal to 4, it is possible that, with respect to the first row, the two-frame inversion is performed at the fourth frame; with respect to the second row, the two-frame inversion is performed at the eighth frame; with respect to the third row, the two-frame inversion is performed at the twelfth frame; with respect to the fourth row, the two-frame inversion is performed at the sixteenth frame, and the like. For another example, FIG. 8 shows polarity change in respective rows in each of the frames with N=2; polarity arrangement of the frames is as shown in FIG. 7; as can be seen from table 8 and FIG. 7 that, with respect to the first row, the two-frame inversion is performed at the second frame; with respect to the second row, the two-frame inversion is performed at the fourth frame; with respect to the third row, the two-frame inversion is performed at the sixth frame; with respect to the fourth row, the two-frame inversion is performed at the eighth frame, and the like. For another example, when N is equal to 4, it is possible that, with respect to the first row, the two-frame inversion is performed at the fourth frame; with respect to the second row, the two-frame inversion is performed at the eighth frame; with respect to the third row, the two-frame inversion is performed at the twelfth frame; with respect to the fourth row, the two-frame inversion is performed at the sixteenth frame, and the like.

TABLE 7

Polarity table of the frames in the polarity inversion driving method of the present embodiment with N = 1

| | frame sequence number | | | | | | | | | | | | | | | | | |
|---|---|---|---|---|---|---|---|---|---|---|---|---|---|---|---|---|---|---|
| row | 1 | 2 | 3 | 4 | 5 | 6 | 7 | 8 | 9 | 10 | 11 | 12 | 13 | 14 | 15 | 16 | 17 | 18 |
| 1 | H | H | L | H | L | H | L | H | L | L | H | L | H | L | H | L | H | H |
| 2 | L | H | H | L | H | L | H | L | H | L | L | H | L | H | L | H | L | H |
| 3 | H | L | H | H | L | H | L | H | L | H | L | L | H | L | H | L | H | L |
| 4 | L | H | L | H | H | L | H | L | H | L | H | L | L | H | L | H | L | H |
| 5 | H | L | H | L | H | H | L | H | L | H | L | H | L | L | H | L | H | L |
| 6 | L | H | L | H | L | H | H | L | H | L | H | L | H | L | L | H | L | H |
| 7 | H | L | H | L | H | L | H | H | L | H | L | H | L | H | L | L | H | L |
| 8 | L | H | L | H | L | H | L | H | H | L | H | L | H | L | H | L | L | H |

TABLE 8

Polarity table of the frames in the polarity inversion driving method of the present embodiment with N = 2

| | frame number | | | | | | | | | | | | | | | | | |
|---|---|---|---|---|---|---|---|---|---|---|---|---|---|---|---|---|---|---|
| row | 1 | 2 | 3 | 4 | 5 | 6 | 7 | 8 | 9 | 10 | 11 | 12 | 13 | 14 | 15 | 16 | 17 | 18 |
| 1 | H | H | L | H | L | H | L | H | L | H | L | H | L | H | L | H | L | L |
| 2 | L | H | L | L | H | L | H | L | H | L | H | L | H | L | H | L | H | L |
| 3 | H | L | H | L | H | H | L | H | L | H | L | H | L | H | L | H | L | H |
| 4 | L | H | L | H | L | H | L | L | H | L | H | L | H | L | H | L | H | L |
| 5 | H | L | H | L | H | L | H | L | H | H | L | H | L | H | L | H | L | H |
| 6 | L | H | L | H | L | H | L | H | L | H | L | L | H | L | H | L | H | L |
| 7 | H | L | H | L | H | L | H | L | H | L | H | L | H | H | L | H | L | H |
| 8 | L | H | L | H | L | H | L | H | L | H | L | H | L | H | L | L | H | L |

In the present embodiment, in the x-th frame (first frame) as the start frame of each of half inversion driving periods, polarities of any two rows adjacent to each other are opposite, and polarities of two adjacent sub-pixels on each of the rows are opposite; all of these are to reduce the impact of interference phenomenon of chroma and brightness in a frame. Of course, for practical application, it is also possible to adjust the polarity arrangement of the respective polarity arrangement units and adjust the division of the respective polarity arrangement units as necessary, and is not limited to the polarity arrangement and division form of the polarity arrangement units exemplified in the present embodiment.

Third Embodiment

Embodiments of the present disclosure also provide a driving apparatus for implementing any one of the above polarity inversion driving methods for the liquid crystal display panel; as shown in FIG. 8, the polarity inversion driving apparatus for the liquid crystal display panel comprises components such as a timing controller, an calculator, a source driver, a gate driver and the like; signals transmitted by a custom system to the liquid crystal display basically comprises image display signals R, G and B, enable signal DE, clock signal MCLK, vertical synchronization signal Vsync and horizon synchronization signal Hsync and control signal of the calculator Cs; the timing controller transmits an image data signal (DATA), a row start signal (STH) and a row latch signal (TP) to the source driver, and transmits a column start signal (STV), a column clock signal (CPV) and an output enable signal OE to the gate driver, so as to allow the liquid crystal display panel to display images; the timing controller outputs M first polarity inversion signals corresponding to each of the polarity arrangement units respectively to the calculator, and the first polarity inversion signal and the control signal Cs are subjected to the logic operation in the calculator to form a second polarity inversion signal and inputted to the source driver; the first polarity inversion signal of each of the frames is the second polarity inversion signal of the previous frame; in each of the half inversion driving periods, the second polarity inversion signal in the (x+1)th frame corresponding to the first polarity arrangement unit is an in-phase signal of the second polarity inversion signal in the x-th frame corresponding to the first polarity arrangement unit, and the second polarity inversion signal in the other frames corresponding to the first polarity arrangement unit is an out-phase signal of the second polarity inversion signal in the previous frame corresponding to the first polarity arrangement unit; the second polarity inversion signal in the (x+m×N+1)-th frame corresponding to the (m+1)-th polarity arrangement unit is an in-phase signal of the second polarity inversion signal in the (x+m×N)-th frame corresponding to the (m+1)-th polarity arrangement unit, and the second polarity inversion signal in the other frames corresponding to the (m+1)-th polarity arrangement unit is an out-phase signal of the second polarity inversion signal in the previous frame corresponding to the (m+1)-th polarity arrangement unit. In this way, the two-frame inversion being performed once on a polarity arrangement unit is realized every N frames, so that in each of the polarity inversion driving periods, the overall polarities of the sub-pixels will not be deflected to a certain polarity, which prevents the charges from accumulating, and thus it is avoided that liquid crystal polarization or image sticking occurs in the liquid crystal at time of polarity inversion driving. The first polarity inversion signal POL can be the polarity inversion signal POL_1 or polarity inversion signal POL_2 described in the first embodiment, or the like, and the logic operation that the first polarity inversion signal and the control signal C2 are subjected to in the calculator can be implemented in several ways; for example, the second polarity inversion signal corresponding to the first polarity arrangement unit is the POL1, the control signal Cs1 corresponding to the second polarity inversion signal is a high level signal in the x-th frame, and is at the low level in other frames; the second polarity inversion signal in each of the frames corresponding to first polarity arrangement unit and the control signal are subjected to a logic operation of $\overline{POL_1}\times\overline{Cs_1}+POL_1\times Cs_1$ in the calculator to generate a corresponding second polarity inversion signal in the next frame; the second polarity inversion signal corresponding the (m+1)-th polarity arrangement unit is the $POL_{m+1}$; the control signal $Cs_{m+1}$ corresponding to the second polarity inversion signal is the high level signal in the (x+m×N)-th frame, and is at low level in the other frames; the second polarity inversion signal in each of the frames corresponding to the (m+1)-th polarity arrangement unit and the control signal are subjected to a logic operation of $\overline{POL_m}\times\overline{Cs_m}+POL_m\times Cs_m$ in the calculator to generate a corresponding second polarity inversion signal in the next frame; for another example, the second polarity inversion signal corresponding to the (m+1)-th polarity arrangement unit is the $POL_{m+1}$, the control signal $Cs_{m+1}$ corresponding to the second polarity inversion signal is the low level in the (x+m×N)-th frame, and is at high level in the other frames; the second polarity inversion signal in each of the frames corresponding to first polarity arrangement unit and the control signal are subjected to a logic operation of $\overline{POL_1}\times Cs_1+POL_1\times\overline{Cs_1}$ in the calculator to generate a corresponding second polarity inversion signal in a next frame; the second polarity inversion signal corresponding to the (m+1)-th polarity arrangement unit is the $POL_{m+1}$, the control signal $Cs_{m+1}$ corresponding to the second polarity inversion signal is the low level in the (x+m×N)-th frame, and is at high level in other frames; the second polarity inversion signal in each of the frames corresponding to the (m+1)-th polarity arrangement unit and the control signal are subjected to a logic operation of $\overline{POL_m}\times Cs_m+POL_m\times\overline{Cs_m}$ in the calculator to generate a corresponding second polarity inversion signal in a next frame.

An embodiment of the present disclosure further provides a display device comprising the above polarity inversion driving apparatus for the liquid crystal display panel; since the adopted polarity inversion driving apparatus addresses such a issue that liquid crystal polarization or image sticking occurs in the liquid crystal at time of polarity inversion driving, this display device enjoys a relatively high reliability, and can optimize and improve user's experience to some extent. The display device can be any of products or means with display function, such as liquid crystal display panel, electronic paper, liquid crystal TV, liquid crystal display, organic electroluminescence display, digital photo frame, mobile, tablet computer or the like.

The above embodiments are only intended to explain the present disclosure, and are not a limitation to the present disclosure; those skilled in the art can make various changes and modifications without departing from the spirit and scope of the present disclosure; therefore, all of the equivalent technical solutions should also fall into the protection scope of the present invention.

What is claimed is:

1. A polarity inversion driving method for a liquid crystal display panel, wherein each of frames is divided into M polarity arrangement units in a same manner, every 2×M×N frames form one inversion driving period, and in each of half inversion driving periods:

$\exists!x\epsilon(0, M\times N]$, between an x-th frame and a (x+1)-th frame, except that polarities of first polarity arrangement units are same, polarities of all polarity arrangement units are opposite;

$\forall m\epsilon[0, M)$, between a (x+m×N)-th frame and a (x+m×N+1)-th frame, except that polarities of (m+1)-th polarity arrangement units are same, polarities of all polarity arrangement units are opposite;

wherein a polarity of each of other frames is opposite to that of a frame adjacent thereto;

wherein, each of M, N, x and m is an integer number, and value of M×N is an even number; when (x+1)>M×N, (x+1) represents the first frame in the half inversion driving period; when (x+m×N)>M×N, (x+m×N) represents the (x+m×N−M×N)-th frame in the half inversion driving period; when (x+m×N+1)>M×N, (x+m×N+1) represents the (x+m×N−M×N+1)-th frame in the half inversion driving period; and in two of half inversion driving periods adjacent to each other, the polarities of corresponding frames are opposite.

2. The polarity inversion driving method for the liquid crystal display panel according to claim 1, wherein, in the x-th frame of each of the half inversion driving periods, polarities of any two adjacent polarity arrangement units are opposite.

3. The polarity inversion driving method for the liquid crystal display panel according to claim 1, wherein each of the frames represents a polarity arrangement unit, N being an even number, polarity inversion driving period is 2N frames, and in each of the half inversion driving periods, only the polarities of one set of two frames adjacent to each other are the same, and the polarities of other sets of two frames adjacent to each other are opposite.

4. The polarity inversion driving method for the liquid crystal display panel according to claim 1, wherein in each of the frames, every P rows form a polarity arrangement unit.

5. The polarity inversion driving method for the liquid crystal display panel according to claim 4, wherein, in each of the frames, each of the rows is a polarity arrangement unit; a first polarity arrangement unit is a first row, and a (m+1)-th polarity arrangement unit is a (m+1)-th row.

6. The polarity inversion driving method for the liquid crystal display panel according to claim 1, wherein M is an even number and N is equal to 1; or M is any integer number and N is equal to 2.

7. The polarity inversion driving method for the liquid crystal display panel according to claim 1, wherein, in each of the polarity arrangement units, the polarities of any two adjacent sub-pixels are opposite.

8. The polarity inversion driving method for the liquid crystal display panel according to claim 7, wherein the polarity is a polarity with respect to a common electrode voltage.

9. An apparatus for implementing the polarity inversion driving method for the liquid crystal display panel according to claim 1, comprising a timing controller, a source driver and a calculator, wherein the timing controller is configured to output M first polarity inversion signals corresponding to each of the polarity arrangement units to the calculator, and the first polarity inversion signal and the control signal are subjected to a logic operation in the calculator to form a second polarity inversion signal to be inputted to the source driver;

the first polarity inversion signal of each of the frames is the second polarity inversion signal in a previous frame;

in each of half inversion driving periods, the second polarity inversion signal in the (x+m×N+1)-th frame corresponding to the (m+1)-th polarity arrangement unit is an in-phase signal of a corresponding second polarity inversion signal in the (x+m×N)-th frame, and the second polarity inversion signal in the other frames corresponding to the (m+1)-th polarity arrangement unit is an out-phase signal of the corresponding second polarity inversion signal in the previous frame.

10. The apparatus according to claim 9, wherein the second polarity inversion signal corresponding to the (m+1)-th polarity arrangement unit is $POL_{m+1}$, the control signal $Cs_{m+1}$ corresponding to the second polarity inversion signal is at a high level in the (x+m×N)-th frame, and is at a low level in other frames; the second polarity inversion signal in each of the frames corresponding to the (m+1)-th polarity arrangement unit and the control signal are subjected to a logic operation of $\overline{POL_m}\times\overline{Cs_m}+POL_m\times Cs_m$ in the calculator to generate a corresponding second polarity inversion signal in a next frame.

11. The apparatus according to claim 9, wherein the second polarity inversion signal corresponding to the (m+1)-th polarity arrangement unit is $POL_{m+1}$, the control signal $Cs_{m+1}$ corresponding to the second polarity inversion signal is at a low level in the (x+m×N)-th frame, and is at a high level in other frames; the second polarity inversion signal in each of the frames corresponding to the (m+1)-th polarity arrangement unit and the control signal are subjected to a logic operation of $\overline{POL_m}\times Cs_m+POL_m\times\overline{Cs_m}$ in the calculator to generate a corresponding second polarity inversion signal in a next frame.

12. A display device, comprising the apparatus according to claim 9.

13. The polarity inversion driving method for the liquid crystal display panel according to claim 2, wherein each of the frames represents a polarity arrangement unit, N being an even number, polarity inversion driving period is 2N frames, and in each of the half inversion driving periods, only the polarities of one set of two frames adjacent to each other are the same, and the polarities of other sets of two frames adjacent to each other are opposite.

14. The polarity inversion driving method for the liquid crystal display panel according to claim 2, wherein in each of the frames, every several P rows form a polarity arrangement unit.

15. The polarity inversion driving method for the liquid crystal display panel according to claim 2, wherein, in each of the polarity arrangement units, the polarities of any two adjacent sub-pixels are opposite.

* * * * *